United States Patent [19]

Knop et al.

[11] 4,423,422

[45] Dec. 27, 1983

[54] DIAGONAL-CONICAL HORN-REFLECTOR ANTENNA

[75] Inventors: Charles M. Knop, Lockport; Edward L. Ostertag, New Lenox, both of Ill.

[73] Assignee: Andrew Corporation, Orland Park, Ill.

[21] Appl. No.: 291,431

[22] Filed: Aug. 10, 1981

[51] Int. Cl.[3] ..... H01Q 13/02

[52] U.S. Cl. ..... 343/786

[58] Field of Search ..... 343/786, 840, 912

[56] References Cited

U.S. PATENT DOCUMENTS

| | | | |
|---|---|---|---|
| 3,510,873 | 5/1970 | Treuisan | 343/786 |
| 3,510,874 | 5/1970 | Takeichi et al. | 343/786 |
| 3,550,142 | 12/1970 | Dawson | 343/781 |
| 3,936,837 | 2/1976 | Coleman et al. | 343/781 |
| 4,231,043 | 10/1980 | Semplak | 343/786 |
| 4,249,183 | 2/1981 | Bui Hai | 343/781 R |

FOREIGN PATENT DOCUMENTS 305 1/1979 European Pat. Off. .

OTHER PUBLICATIONS

"The Electrical Characteristics of the Conical Horn-Reflector Antenna", *The Bell System Technical Journal*, Jul. 1963, pp. 1187–1211.

Y. Takeichi, et al., "The Diagonal Horn-Reflector Antenna", IEEE G-AP Symp., pp. 279–285, Dec. 9–11, 1969.

Dybdal, Horn Antenna Sidelobe Reduction, IEEE, AP-S Int. Symp. 1977, Jun. 21, 1977, pp. 324–327.

Coleman et al., Low Sidelobe Antennas . . . Systems, IEEE, AP-S, Int. Symp. 1975, pp. 240–243.

*Primary Examiner*—Eli Lieberman

*Attorney, Agent, or Firm*—Leydig, Voit, Osann, Mayer & Holt, Ltd.

[57] ABSTRACT

A horn-reflector microwave antenna has a reflector plate which is a section of a paraboloid, and a flared feed horn for supplying microwave signals to the reflector plate. The horn has a conical section forming a circular aperture at the wide end, which is the end closer to the reflector plate, and a pyramidal section forming a square aperture at the narrow end, which is the end farther away from the reflector plate. Microwave signals are supplied to the feed horn with the electrical field extending along a diagonal of the square aperture.

8 Claims, 9 Drawing Figures

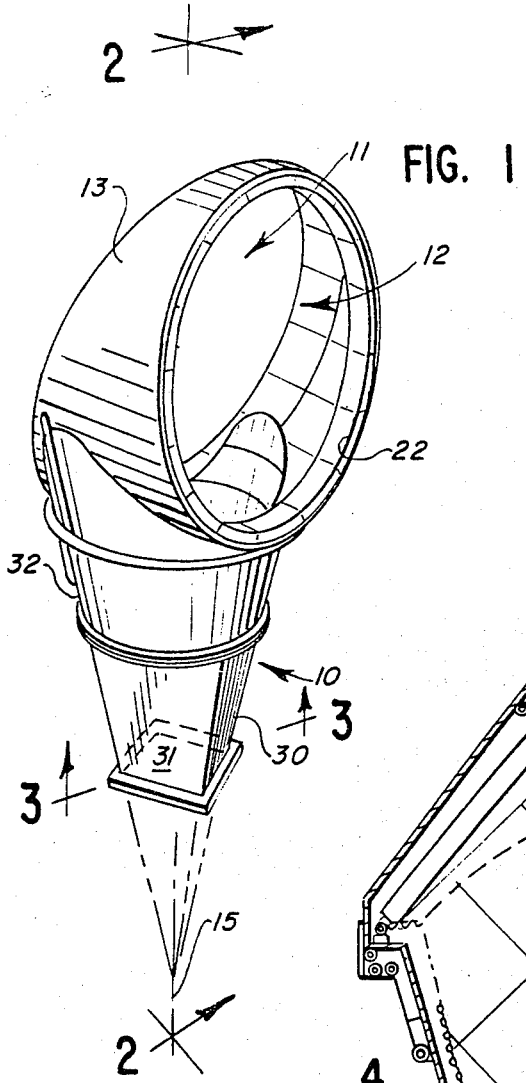
FIG. 1
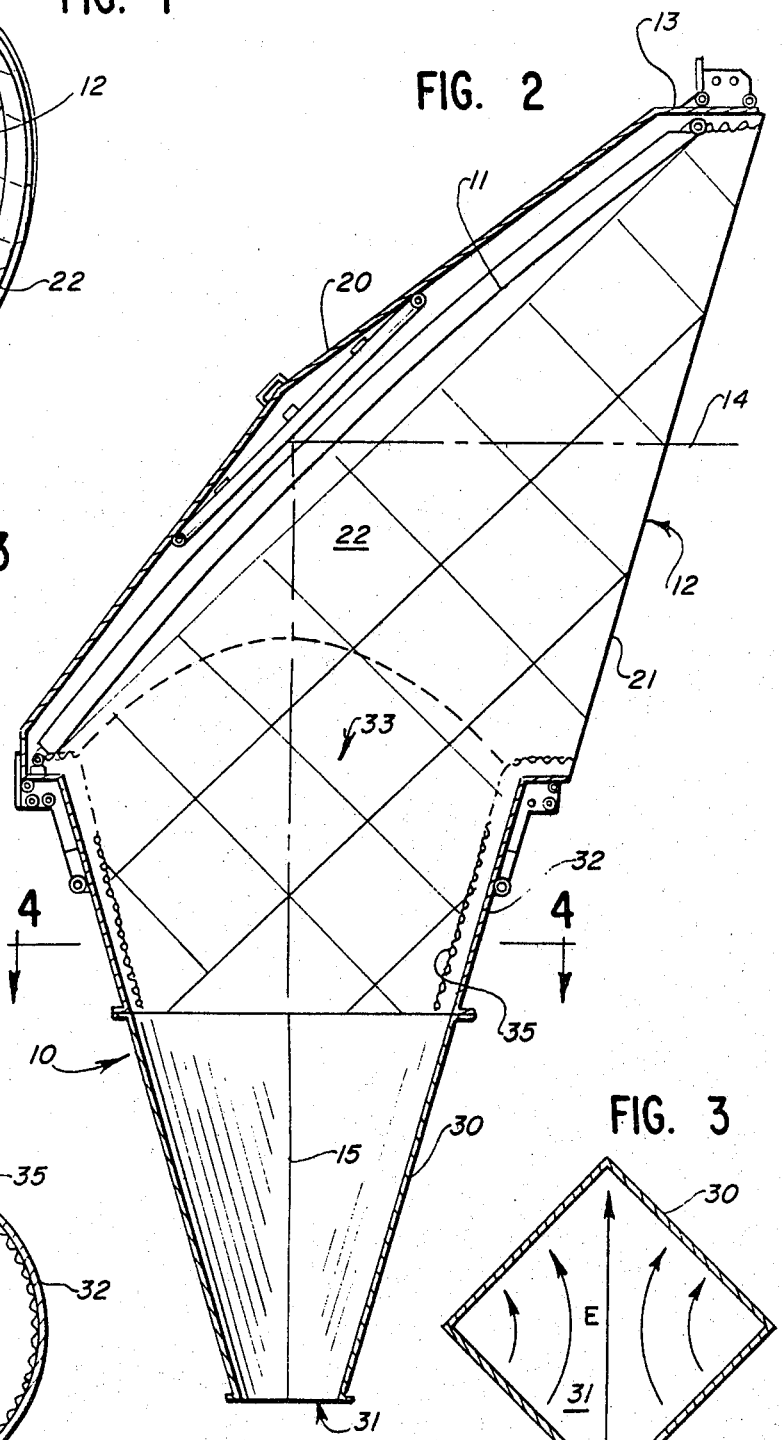
FIG. 2
FIG. 4
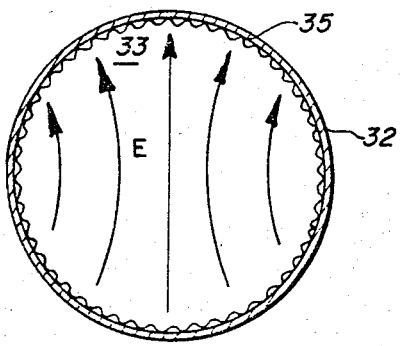
FIG. 3
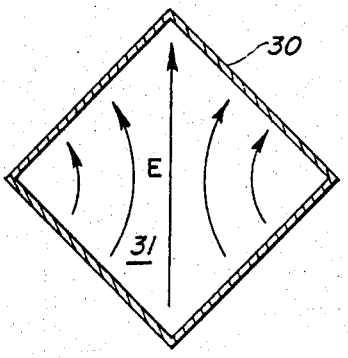

DIAGONAL-CONICAL HORN-REFLECTOR ANTENNA

DESCRIPTION OF THE INVENTION

The present invention relates generally to microwave antennas and, more particularly, to microwave antennas of the horn-reflector type.

Conical feeds for horn-reflector antennas have been known for many years. For example, a 1963 article in *The Bell System Technical Journal* describes the selection of a conical horn-reflector antenna for use in satellite communication ground stations (Hines et al., "The Electrical Characteristics Of The Conical Horn-Reflector Antenna", *The Bell System Technical Journal,* July 1963, pp. 1187–1211). A conical horn-reflector antenna is also described in Dawson U.S. Pat. No. 3,550,142, issued Dec. 22, 1970. One of the problems encountered with such antennas is that the radiation pattern envelope (hereinafter referred to as the "RPE") in the E plane is substantially wider than the RPE of the H plane. When used in terrestrial communication systems, the wide beamwidth in the E plane can cause interference with signals from other antennas.

So-called "diagonal" horn-reflector antennas have also been known for many years. For example, a 1969 article by Y. Takeichi et al. entitled "The Diagonal Horn-Reflector Antenna", *IEEE G-AP Symp.,* pp. 279–285, Dec. 9–11, 1969, describes such antennas, in which the flared horn has a square aperture (i.e., the cross section of the horn, taken in a plane perpendicular to its axis, is square). Such antennas have similar RPE's in the E and H planes, but they have a relatively high wind loading factor, which increases the cost of using such antennas because of the sturdier mounting structures required. In particular, the aperture of a diagonal horn-reflector antenna is extremely high, thereby greatly increasing the wind loading factor and attendant structural requirements.

It is a primary object of the present invention to provide an improved horn-reflector antenna which produces virtually identical RPE's in the E and H planes and also has a relatively low wind loading factor. In this connection, a related object of the invention is to provide such an antenna that produces equal E and H plane patterns wherein the equality exists from the center axis all the way out to the periphery of the antenna.

It is a further object of the invention to provide such an improved horn-reflector antenna which produces extremely narrow E-plane RPE's without significantly degrading the H-plane RPE or any other performance characteristic of the antenna.

It is another object of this invention to provide an improved horn-reflector antenna whose performance is superior to that of conical horn-reflector antennas, and yet costs about the same as a conical horn-reflector antenna.

Yet another object of this invention to provide such an improved horn-reflector antenna which offers a large bandwidth.

A still further object of the invention is to provide such an improved horn-reflector antenna which achieves the foregoing objectives without any significant adverse effect on the gain of the antenna.

Other objects and advantages of the invention will be apparent from the following detailed description and the accompanying drawings.

In accordance with the present invention, there is provided an improved horn-reflector antenna comprising a reflector plate which is a section of a paraboloid; a flared feed horn for supplying microwave signals to the reflector plate, the horn having a conical section forming a circular aperture at the wide end, which is the end closer to the reflector plate, and a pyramidal section forming a square aperture at the narrow end, which is the end farther away from the reflector plate; and means for supplying microwave signals to the feed horn with the electric field extending across the diagonal of the square aperture.

In the drawings:

FIG. 1 is a perspective view of a horn-reflector antenna embodying the present invention;

FIG. 2 is an enlarged vertical section taken generally along line 2—2 in FIG. 1;

FIG. 3 is an enlarged horizontal section taken generally along line 3—3 in FIG. 1;

FIG. 4 is a section taken generally along line 4—4 in FIG. 2;

Figure 5:
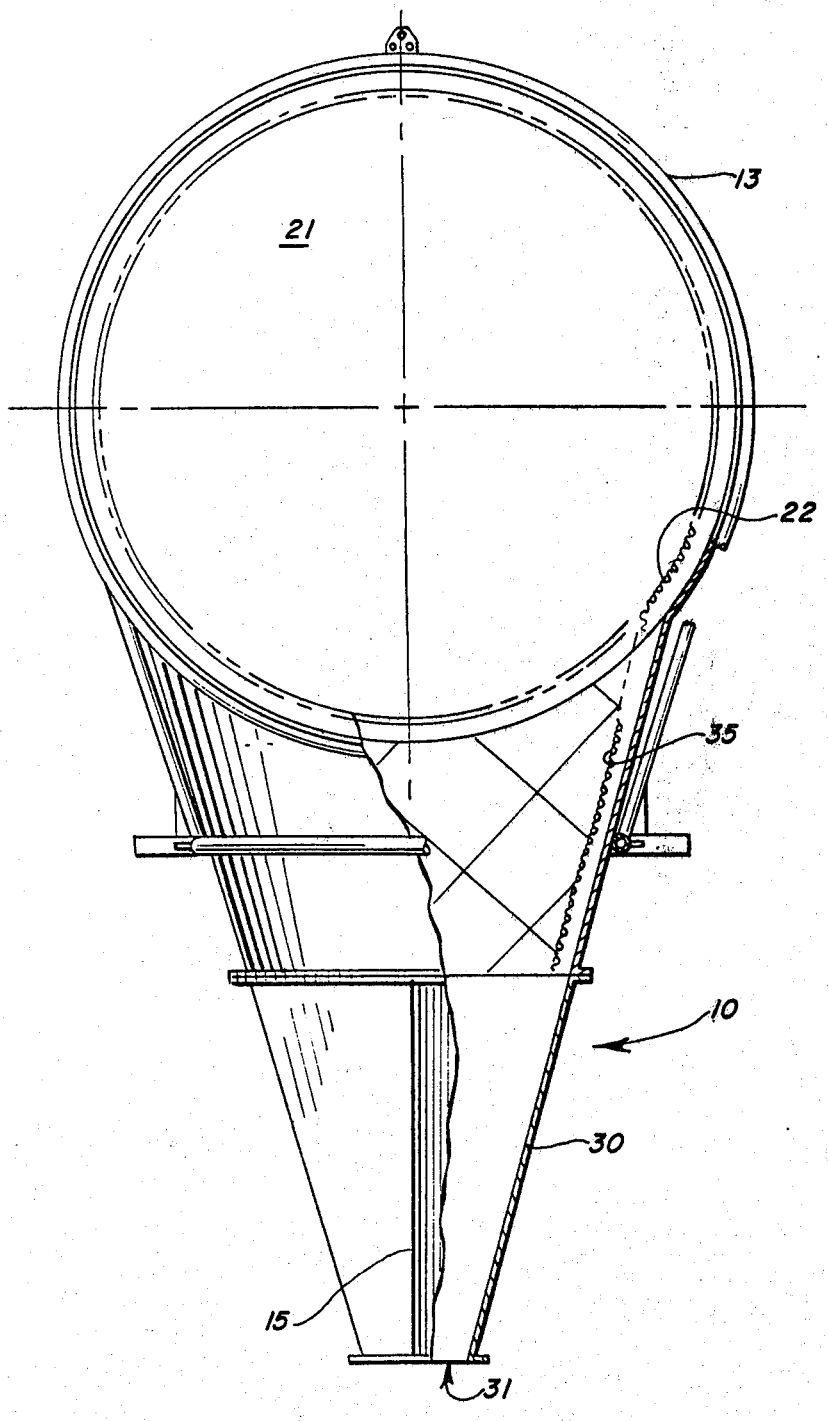
FIG. 5 is an enlarged front elevation, partially in section, of the antenna of FIGS. 1–4.
Figure 6A:
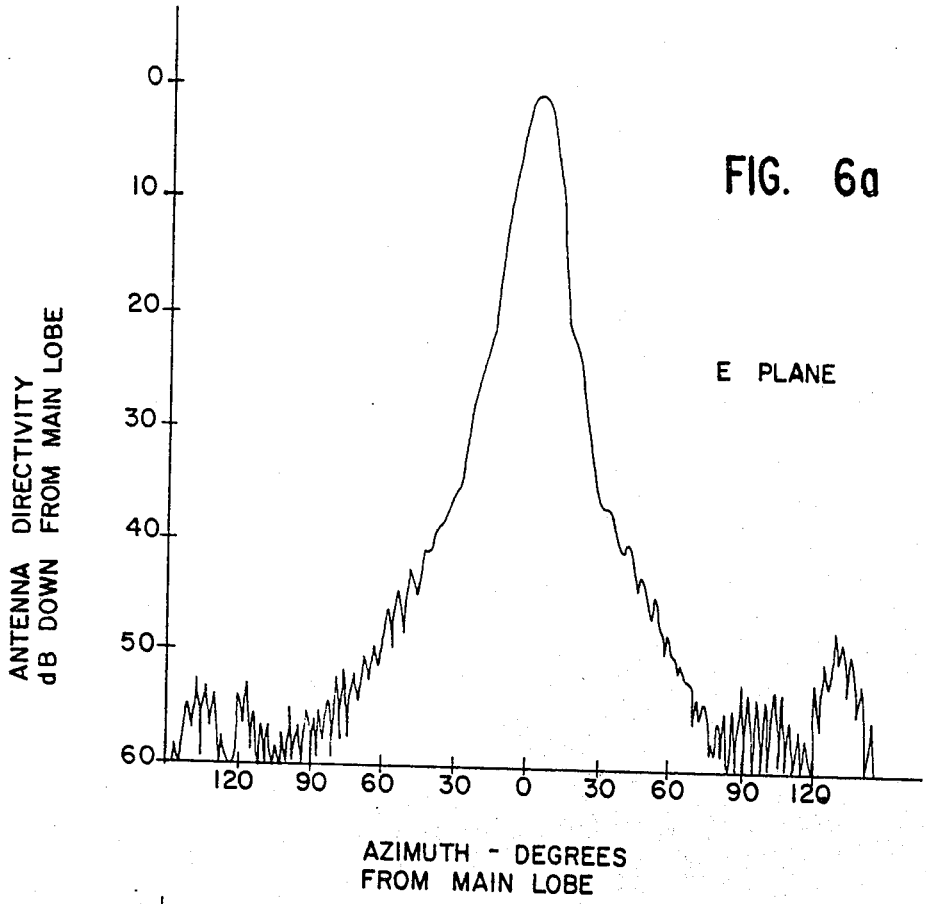
Figure 6B:
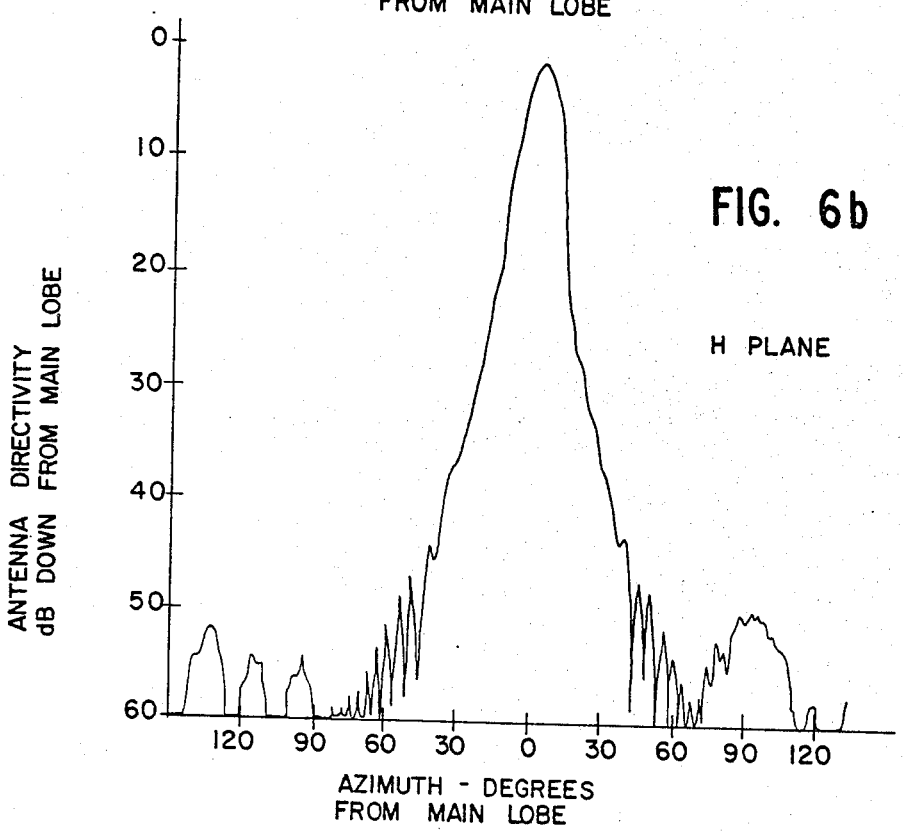
Figure 7B:
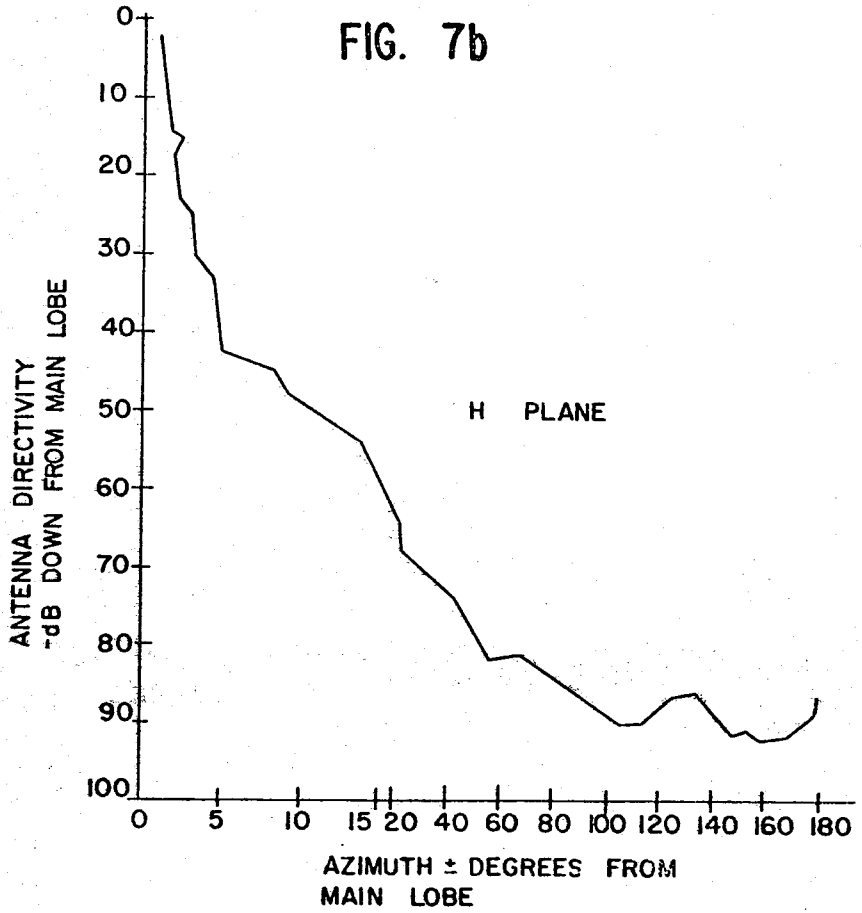
Figure 7A:
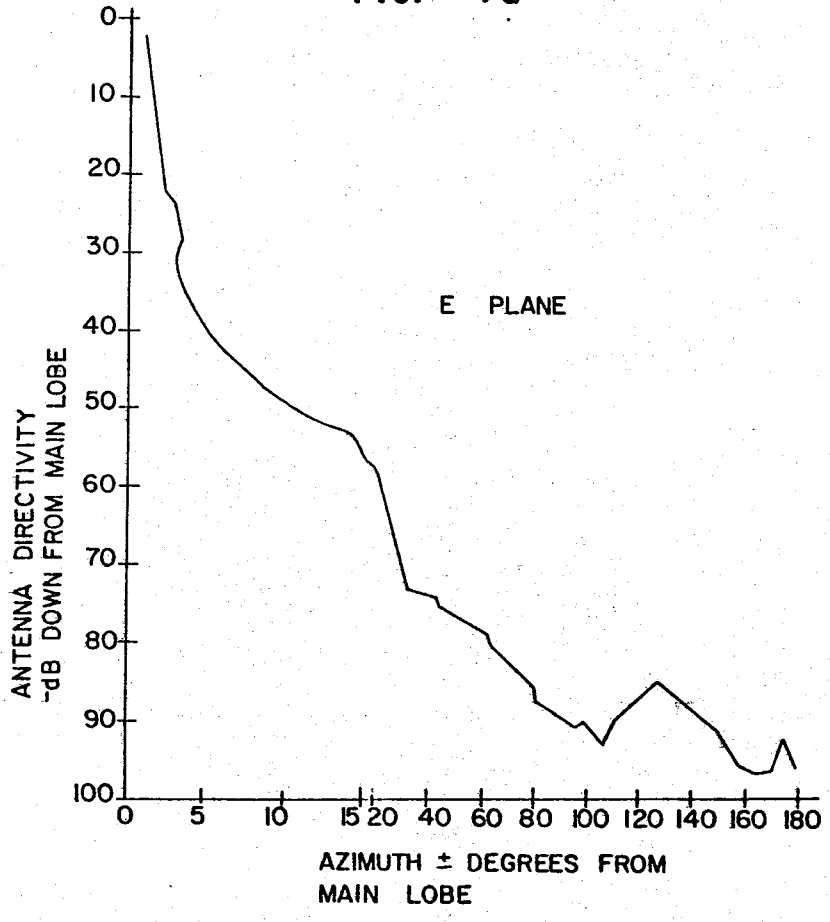

FIGS. 6*a* and 6*b* are measured patterns of the E and H plane field distributions produced by the feed horn portion of the antenna of FIGS. 1–5 at 6 GHz; and FIGS. 7*a* and 7*b* are measured RPE's produced in the E and H planes by the complete antenna of FIGS. 1–5 at 6 GHz.

While the invention will be described in connection with certain preferred embodiments, it will be understood that it is not intended to limit the invention to those particular embodiments. On the contrary, it is intended to cover all alternatives, modifications and equivalents as may be included within the spirit and scope of the invention as defined by the appended claims.

Turning now to the drawings, and referring first to FIGS. 1 and 2, there is illustrated a horn-reflector microwave antenna having a flared horn 10 for guiding microwave signals to a parabolic reflector plate 11. From the reflector plate 11, the microwave signals are transmitted through an aperture 12 formed in the front of a cylindrical section 13 which is attached to both the horn 10 and the reflector plate 11 to form a completely enclosed integral antenna structure.

The parabolic reflector plate 11 is a section of a paraboloid representing a surface of revolution formed by rotating a parabolic curve about an axis which extends through the vertex and the focus of the parabolic curve. As is well known, any microwaves originating at the focus of such a parabolic surface will be reflected by the plate 11 in planar wavefronts perpendicular to said axis, i.e., in the direction indicated by the arrow 14 in FIG. 2. Thus, the horn 10 of the illustrative antenna is arranged so that its apex coincides with the focus of the paraboloid, and so that the axis 15 of the horn is perpendicular to the axis of the paraboloid. With this geometry, a diverging spherical wave emanating from the horn 10 and striking the reflector plate 11 is reflected as a plane wave which passes through the aperture 12 with an orientation which is perpendicular to the plane formed by the intersection of the axis of the horn with the axis of the paraboloid. The cylindrical section 13 serves as a shield which prevents the reflector plate 11 from producing interfering side and back signals and also helps to capture some spillover energy launched from the horn 10. It will be appreciated that the horn 10, the reflector plate 11, and the cylindrical shield 13 are usually all formed of conductive metal (though it is only essential that the reflector plate 11 have a metallic surface).

To protect the interior of the antenna from both the weather and stray signals, the top of the reflector plate 11 is covered by a panel 20 attached to the cylindrical shield 13. A radome 21 also covers the aperture 12 at the front of the antenna to provide further protection from the weather. The inside surface of the cylindrical shield 13 is covered with an absorber material 22 to absorb stray signals so that they do not degrade the RPE. Such absorber shield materials are well known in the art, and typically comprise a conductive material such as metal or carbon dispersed throughout a dielectric material and are pyramidal or conical with circular tips in shape.

In accordance with one important aspect of the present invention, the flared horn 10 has a pyramidal section 30 forming a square aperture 31 at the lower end of the horn, and a conical section 32 forming a circular aperture 33 at the top end of the horn. Microwave signals are fed through a circular waveguide into the bottom of the pyramidal section 30 with the electric field being introduced at a corner so that the field extends across the diagonal of the square aperture 31, as illustrated in FIG. 3. Consequently, the resultant field in the aperture 33 of the conical section 32 of the horn has equal E-plane and H-plane distributions. To ensure that the equal E and H plane distributions are maintained throughout the conical section of the horn, the walls of the conical section are lined with a layer of absorber material 35 which extends continuously around the entire inner surface of the cone. Conventional absorber materials may be used for this purpose, one example of which is AAP-ML-73 absorber made by Advanced Absorber Products Inc., Amesbury, Me., U.S.A. The absorber material may be secured to the metal walls of the horn by means of an adhesive.

The equal E and H plane field distributions in the circular aperture 33 of the conical section 32 are illustrated in FIGS. 6*a* and 6*b* which show patterns produced by the feed horn portion of the antenna of FIGS. 1–5 at 6 GHz with a terminating diameter of 20 inches at the large end of the conical section. It can be seen that the patterns are virtually identical in the E and H planes, and this equality exists from the center axis all the way out to the periphery.

FIGS. 7*a* and 7*b* show actual RPE's produced at 6 GHz n the E and H planes, respectively, by the complete antenna of FIGS. 1–5 (using the same feed horn used to produce the patterns of FIGS. 6*a*–6*d*). Again the patterns are virtually identical in the E and H planes. For example, comparing the 65-dB levels of the two RPE's (65 dB is a reference point commonly used in specifying the performance characteristics of such antennas), it can be seen that the width of both the E-plane RPE and the H-plane RPE at this level is about 22° off the axis.

By establishing equal E and H plane patterns in the diagonal horn section, and then maintaining those patterns in a short conical section which feeds the parabolic reflector, the antenna of this invention provides superior performance without the high wind loading factor and increased structural costs of a diagonal horn-reflector antenna. The antenna of this invention significantly narrows the E plane pattern so that the patterns in the E and H planes are virtually identical, and these results are achieved with little or no sacrifice in gain.

A further advantage of the present invention is that the RPE improvements can be achieved over a relatively wide frequency band. For example, the improvements described above for the antenna illustrated in FIGS. 1–5 can be realized over the frequency bands commonly referred to as 4 GHz, 6 GHz and 11 GHz.

We claim as our invention:

1. A horn-reflector microwave antenna comprising a reflector plate which is a section of a paraboloid, a flared feed horn for supplying microwave signals to said reflector plate, said horn having an absorber-lined conical section forming a circular aperture at the wide end, which is the end closer to said reflector plate, and a pyramidal section forming a square aperture at the narrow end, which is the end farther away from said reflector plate, and means for supplying microwave signals to said feed horn with the electric field extending along a diagonal of said square aperture, the combination of said pyramidal section and said absorber-lined conical section producing substantially equal patterns in the E and H planes.

2. A horn-reflector antenna as set forth in claim 1 wherein said pyramidal section of the flared horn has a square cross-section along the entire length thereof.

3. A horn-reflector antenna as set forth in claim 1 wherein said conical section of the flared horn has a circular cross-section along the entire length thereof.

4. A horn-reflector antenna as set forth in claim 1 wherein the antenna aperture is circular.

5. A method of feeding microwave signals to a reflector plate antenna, said method comprising feeding the signals into the narrow end of a pyramidal horn section having a square aperture, with the electric field extending along a diagonal of the square aperture; feeding the signals from said pyramidal horn section into the narrow end of an absorber-lined conical horn section having a circular aperture; and feeding the signals from said conical horn section onto said reflector plate which is a section of a paraboloid, the combination of said pyramidal section and said absorber-lined conical section producing substantially equal patterns in the E and H planes.

6. A method as set forth in claim 5 wherein said pyramidal and conical horn sections are coaxial and contiguous.

7. A method as set forth in claim 5 wherein said pyramidal and conical horn sections form a single flared horn.

8. A method as set forth in claim 5 wherein the antenna aperture is circular.

* * * * *